United States Patent [19]

Pohl

[11] 4,032,180

[45] June 28, 1977

[54] LOCKING DEVICE FOR WASHING MACHINE DOOR

[75] Inventor: Walter Pohl, Naples, Italy

[73] Assignee: Texas Instruments Incorporated, Dallas, Tex.

[22] Filed: Aug. 16, 1974

[21] Appl. No.: 498,001

[30] Foreign Application Priority Data

Aug. 21, 1973 Italy ..... 52111/73

[52] U.S. Cl. ..... 292/341.16; 200/61.64; 292/DIG. 69; 337/53

[51] Int. Cl.[2] ..... E05B 15/02; B65H 25/14

[58] Field of Search ..... 292/106, 207, 341.15, 292/341.16, 341.17, DIG. 66, DIG. 69; 126/197; 219/10.55 C, 413; 134/58 DL; 200/61.62, 61.64; 317/142 TD; 337/53, 110

[56] References Cited

UNITED STATES PATENTS

| | | | |
|---|---|---|---|
| 1,872,560 | 8/1932 | Breisky | 317/142 TD X |
| 2,461,903 | 2/1949 | Kurtz | 317/142 TD X |
| 2,489,391 | 11/1949 | Thomson | 337/53 X |
| 2,599,473 | 6/1952 | Miller | 337/53 X |
| 2,908,848 | 10/1959 | Hull | 317/142 TD |
| 3,181,037 | 4/1965 | Klepp | 317/142 TD |
| 3,222,481 | 12/1965 | Lorenz | 337/53 X |
| 3,335,319 | 8/1967 | Warner | 219/501 UX |
| 3,360,197 | 12/1967 | Stringh am | 337/100 |
| 3,436,502 | 4/1969 | Egli | 200/83 P |
| 3,458,675 | 7/1969 | Gaudio | 200/61.64 |
| 3,484,858 | 12/1969 | Jordan et al. | 219/413 |
| 3,525,914 | 8/1970 | Vind | 337/107 UX |
| 3,546,410 | 12/1970 | Brighenti | 200/61.62 X |
| 3,586,939 | 6/1971 | Buiting | 337/107 X |
| 3,596,023 | 7/1971 | Kothe et al. | 200/83 P |
| 3,617,957 | 11/1971 | Brighenti | 200/61.64 X |
| 3,627,987 | 12/1971 | Holtkamp | 219/413 |
| 3,638,638 | 2/1972 | Phifer | 126/197 |
| 3,674,952 | 7/1972 | Ellenberger | 200/61.64 |
| 3,776,216 | 12/1973 | Pirker et al. | 126/197 |
| 3,815,942 | 6/1974 | White | 292/DIG. 66 X |

*Primary Examiner*—Roy D. Frazier
*Assistant Examiner*—Thomas J. Holko
*Attorney, Agent, or Firm*—Harold Levine; John A. Haug; James P. McAndrews

[57] ABSTRACT

An appliance door lock has a thermally actuable latch regulated by a voltage responsive heater arranged to close the appliance circuit only after the latch has been set, to delay unlatching of the door after interruption of the appliance operation, and to assure safe latch operation when overloading of the appliance may reduce the current available to regulate lock operation.

1 Claim, 10 Drawing Figures

LOCKING DEVICE FOR WASHING MACHINE DOOR

The present invention, in the field of locking devices for doors of washing machines, has as its object to provide greater safety as opposed to those presently in use.

In the case of washing machines, the guidelines presently in force provide that opening of the door be prevented during the more dangerous washing phases (spinning for example) or that door opening be delayed toward the end of the cycle, until complete stopping of the rotating basket. However, the presently used devices, even if they comply with such norms, make possible, an opening of the door during those washing phases in which the current is lower than the minimum value required for the functioning of the device and a locking of the door only a certain time after starting the washing machine (intervening time).

As opposed to these types of door locks it is an object of the present invention to provide a voltage actuated door lock whose operation is independent of the current absorbed by the washing machine and for assuring locking of the door during the entire period of the washing cycle; to provide a door lock having a thermally actuated switch built into the device which closes the electric circuit of the machine, simultaneously actuates the locking system of the door, whereby it is made impossible to reach into the inside of the washing machine, even from the very first moment of machine operation and whereby this switch will, in case of a lack of power, cut the circuit of the machine before the door can be opened; to provide a door lock having a particular form of clamping element (slide) which makes possible application of the device to the three main types of washing machines, with the door disposed on the front vertical side of the machine and with the hook turned toward the center or the outside, with the door disposed analogously but with the hook controlled by a pushbutton over a movable rod and with the door disposed on the upper horizontal side of the machine; to provide a door lock in which there is mechanical independence of the slide of the electric circuit of the device and in which a supplementary plate (adapter) permits greater flexibility and ease of application, eliminating assembly problems due to the various tolerances of the striker-hook-doorhinge combination; to provide such a door lock which is free of radio interference problems due to sticking of contacts, as present in other types of door locks, particularly amper meters; and to provide a door lock which is of simple construction and small dimensions.

The present invention will now be described on hand of the attached Figures, in which:

FIGS. 1*a*, 1*b*, 2 and 3 show various types of washing machines;

FIG. 9 shows the electrical diagram of the device according to the invention.

Figure 1A:
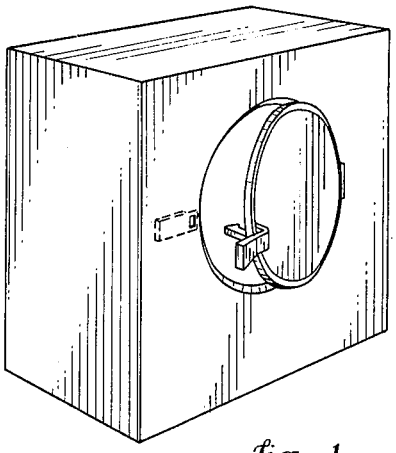
Figure 1B:
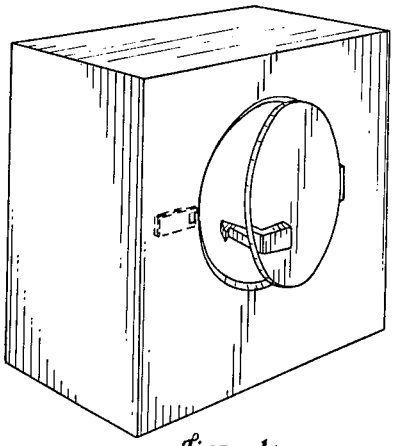
Figure 3:
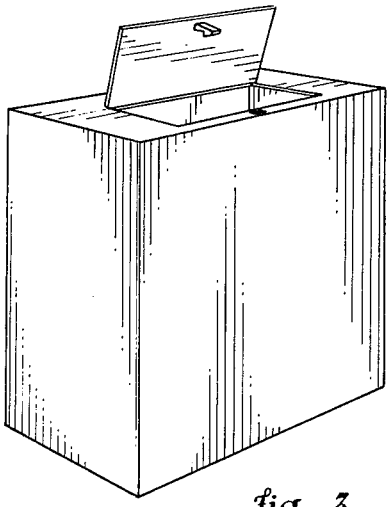
Figure 2:
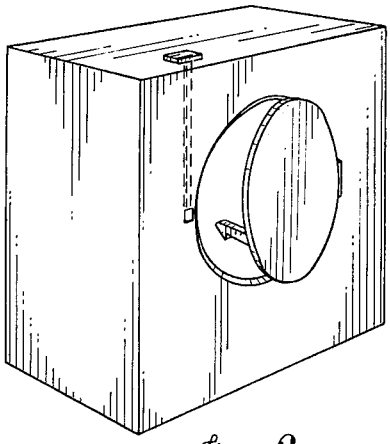

The device of this invention includes an insulating case 1 and comprises a metallic slide 2, a ratchet 3, a centering ball 11, a thrust spring 12 for the ball 11, a thermal switch composed of a cantilever type movable arm 4 which by lowering itself can engage a tooth 3*a* of ratchet 3 and which carries the double contact 5 for engagement with the stationary 6 and deflecting 7 contacts, a heating resistance element 8 for a bimetal element 19, a transfer element 10, an adjusting screw 13 and relative connecting terminals, and a movement transferring element for the bimetal 19 formed by a fork or yoke element 18 the two ends of which (FIGS. 4 and 8) engage corresponding openings 3*b* in ratchet 3.

The particular type of thermal switch used makes possible a snap-action closing of the contacts: the same being achieved by using the strip 4 disposed in an elastic bascule-like arrangement relative to its point of juncture or mounting.

The heating element can be obtained either with a resistance type PTC (with positive temperature coefficient) or with a metallic oxide layer resistance. In the first type, the characteristic increase of the resistance as a function of the temperature permits the use of the maximum initial power; in addition, such a resistance being self-regulating, its temperature and, therefore, that of the switch system is considerably constant. The second type makes possible a high specific load: it being possible, namely, with a resistance of small dimensions and therefore low thermal inertia to obtain within relatively short periods of time the temperatures required for the functioning of the device.

The door lock is fastened mechanically to the machine by means of a plate 14 joined to case 1. The slide 2 is free to slide between case 1 and plate 14: presents slits 15 for a passage of ratchet 3 and opening 16 for a passage of hook 17 of the door.

Figure 8:
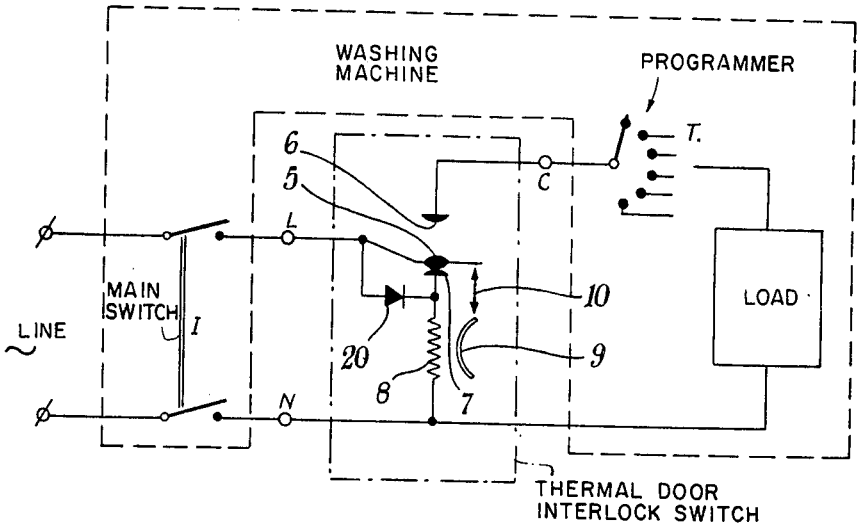
FIG. 8 shows a sectional plan view of plane VIII—VIII of FIG. 7.

The electric circuit for the device is shown in FIG. 8: the door lock is fed, at the power supply system, by main switch I, over terminals L and N; and closing of the circuit of the washing machine is effected over contacts 5 and 6 and terminal C.

The device functions as follows that is, with the door open, the slide 2, is not engaged by hook 17 and is found in the position shown in FIG. 4. In this position the slide is held firm by the centering ball 11. The device is not excited and the elastic configuration strip 4 maintains contacts 5 and 6 in open position and the contacts 5 and 7 in closed position. Consequently, the circuit of the washing machine cannot be supplied with power. Under these conditions, however, even if the device were excited, a closing of the contacts 5 and 6 would be prevented mechanically by ratchet 3 which cannot lower itself since the passage slots 15 are not in correspondence with the ratchet.

Figure 5:
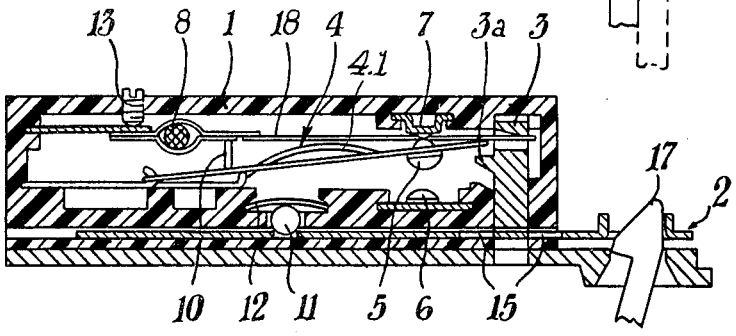
FIGS. 5, 6 and 7 show the device in the working position.

The above applies also to nonperfect closing conditions of the door as shown in FIG. 5.

Figure 6:
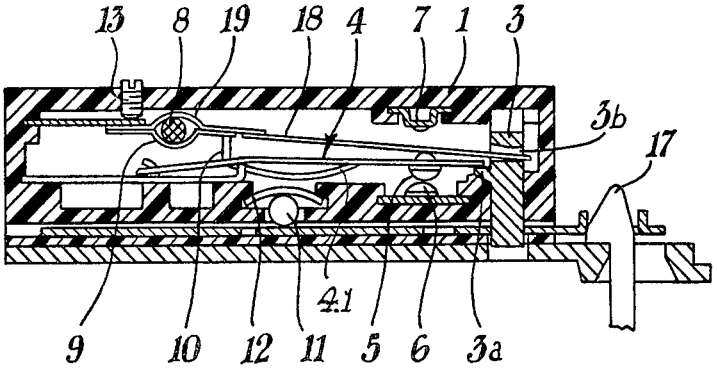
Figure 7:
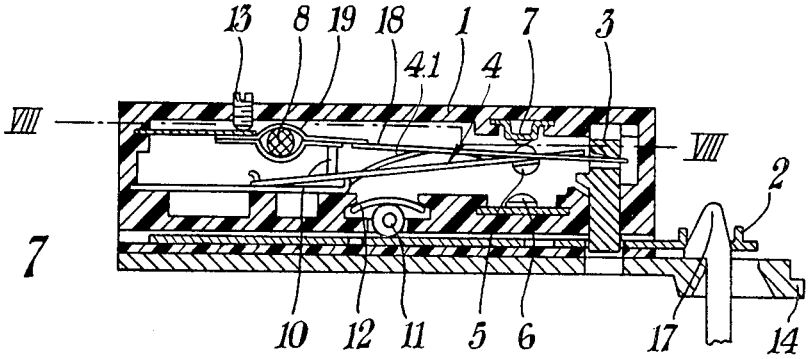
Figure 7A:
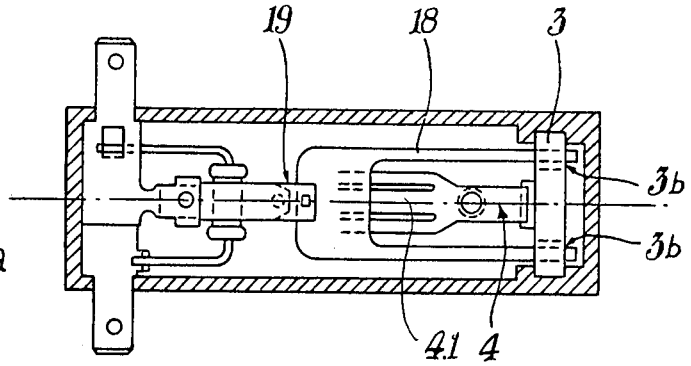

With the door completely closed, on the other hand, the hook 17 engages slide 2 and, overcoming the resistance of ball 11, moves the slide into the position shown in FIG. 6. Slot 15 is thus in correspondence with ratchet 3. Under these conditions, the device is ready for operation. That is, on closing of the main switch I, the resistance element 8 is fed power from the mains. The resistance element heats up and quickly cedes a predetermined quantity of heat to bimetal 19 which, in consequence of an increase of temperature, is deflected and transmits its movement to the forked element 18 which, in engaging the opening 3*b* of ratchet 3, causes lowering of the ratchet in the direction of the slide 2, thus permitting the tooth 3*a* to enable, as shown, a movement of the contact strip 4. Fork 18 therefore allows the ratchet 3 to fit through the opening 15 in the slide 2 locking the closing device in the closed position. The movement of bimetal 19 is also transmitted, through a small rod 10, to strip 4. That section 4.1 of the strip on which rod 10 acts then descends, thus inverting its position as shown in FIG. 6 to overcome the relative preload of the strip 4. In this way there takes place an opening of contacts 5 and 7 and a snap-action closing of contacts 5 and 6. The closing of contacts 5 and 6 makes possible the feeding of the electric circuit of the washing machine or other appliance which will then initiate its operating cycle after its programmer T has been prepared for the particular type of wash desired. At the same time the new position of ratchet 3 extending through slot 15 prevents a sliding of slide 2 and therefore prevents a releasing of hook 17.

Figure 4:
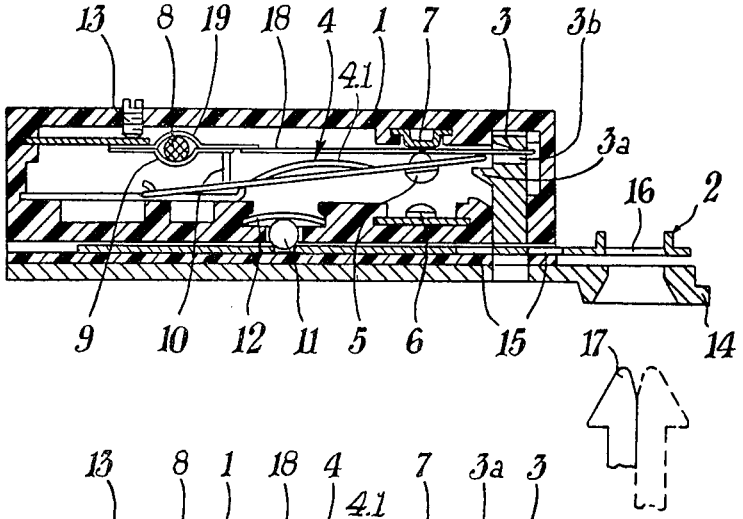
FIG. 4 shows the device of this invention in the resting position.

At the end of the washing cycle, the main switch I opening, the resistance element 8 is deenergized and the bimetal 19, in cooling down, returns within a predetermined period of time to the position shown in FIG. 4. The ratchet 3 is therefore raised by fork 18*e* and frees slot 15 and slide 2. When the hook 17 is then operated, it can slide freely making possible an opening of the door of the washing machine.

The time of cooling, and therefore of moving of the bimetal, is calculated in relation to the time the basket takes to stop when rotating at maximum speed (spinning phase) and also as a function of the temperature of the water (in the heating phase) when the supply power has been removed.

In the circuit diagram shown in FIG. 8 there is further provided the use of a diode 20 whose function is to limit the power supplied to resistance 8 and, therefore, the relative working temperature, obtaining at the same time a considerable constancy of the delaying times as a function of the times of connection of the device.

Such a diode is initially short circuited by the contacts 5 and 7 so as to allow, in the starting phase, feeding of the resistance 8 at full capacity. When the contact lever 4 reverses its position, the contacts 5 and 7 open and the diode 20 is thus in series with the resistance, limiting its power to half for the entire duration of the operation of the washing machine.

The times of intervention and retardation, the thermal energy developed by the resistance element being equal, can be varied by means of an adjusting screw 13 which, acting on the bimetal, varies its position, thus modifying the tensional state of the contact lever 4 and the relative condition of the lever balance relative to its fulcrum.

I claim:

1. A door lock for washing machines and the like comprising body means having a first opening for receiving a door hook and having a second opening, slide means mounted for movement on said body means between an open position and a door hook locking position, said slide means having a first opening to be aligned with said first body opening to receive said door hook when said slide means is in said open position and having a second opening to be aligned with said second body opening when said slide means is in said locking position, a ratchet mounted for movement on said body means into said second openings when said second openings are aligned for holding said slide means in said locking position clamping said door hook, a bimetallic element mounted on said body means for movement in response to selected temperature changes to move said ratchet into and out of said second openings in response to said temperature changes when said second openings are aligned, movable contact means, complementary contact means mounted on said body means, an elastic cantilever element movable with snap-action between a first position spaced from said complementary contact means and a second position engaging said complementary contact means, said cantilever element being movable with said bimetallic element to said second position engaging said movable contact means with said complementary contact means to close an electrical power circuit for said washing machine and the like when said ratchet is disposed in said second body and slide openings, resistance means disposed in heat transfer relation to said bimetallic element, and means for connecting said resistance means in an electrical control circuit of said washing machine and the like for heating said bimetallic element when desired, said means connecting said resistance means in said control circuit comprising a diode arranged in series with said resistance means and additional contact means normally engaged with said movable contact means in said first position thereof in shunting relation to said diode when said slide means is in said open position.

* * * * *